US006051085A

United States Patent [19]

Tanaka et al.

[11] Patent Number: 6,051,085

[45] Date of Patent: Apr. 18, 2000

[54] PROCESS FOR CONTINUOUSLY CASTING SHEET METAL AND APPARATUS FOR CONTINUOUSLY PRODUCING SHEET METAL

[75] Inventors: Shigenori Tanaka, Kimitsu; Satoshi Akamatsu, Hikari, both of Japan

[73] Assignee: Nippon Steel Corporation, Tokyo, Japan

[21] Appl. No.: 08/930,385

[22] PCT Filed: Jan. 24, 1997

[86] PCT No.: PCT/JP97/00165

§ 371 Date: Sep. 23, 1997

§ 102(e) Date: Sep. 23, 1997

[87] PCT Pub. No.: WO97/27341

PCT Pub. Date: Jul. 31, 1997

[30] Foreign Application Priority Data

Jan. 26, 1996 [JP] Japan ..... 8-011949

[51] Int. Cl.[7] ..... C21D 8/00

[52] U.S. Cl. ..... 148/541; 148/603; 164/476; 266/102

[58] Field of Search ..... 148/541, 603; 164/476, 477, 480; 266/102

[56] References Cited

U.S. PATENT DOCUMENTS 4,517,031 5/1985 Takasaki et al. ..... 148/541
4,584,029 4/1986 Chia et al. ..... 148/541

FOREIGN PATENT DOCUMENTS 2-179343 7/1990 Japan .
3-204146 9/1991 Japan .

OTHER PUBLICATIONS

Patent Abstracts of Japan, vol. 016, No. 128 (C–0924), Apr. 2, 1992 & JP 03 294419 A (Nippon Steel Corp.), Dec. 25, 1991.

Patent Abstracts of Japan, vol. 095, No. 008, Sep. 29, 1995 & JP 07 118735 A (Nippon Steel Corp.), May 9, 1995.

Patent Abstracts of Japan, vol. 014, No. 363 (C–0746), Aug. 7, 1990 & JP 02 133528 A (Nippon Steel Corp.), May 22, 1990.

Patent Abstracts of Japan, vol. 014, No. 572 (M–1061), Dec. 19, 1990 & JP 02 247049 A (Nippon Steel Corp.), Oct. 2, 1990.

*Primary Examiner*—Deborah Yee
*Attorney, Agent, or Firm*—Kenyon & Kenyon

[57] ABSTRACT

The carbon content in molten steel is adjusted to be a value not lower than 0.001%, and a thin steel strip is made from this molten steel using a twin drum type continuous casting apparatus by means of direct casting. The thus obtained slab is given a reduction of not lower than 10%. The coagulated steel strip is cooled to a temperature not higher than the temperature determined by a function of the carbon content, cooling speed and ratio of reduction of in-line. After that, the steel strip is reheated and then cooled again to a temperature not higher than the temperature determined by the function of the carbon content. Then the cooled steel strip is coiled. In the above process, a metallic sheet, the surface of which is smooth and the metallic structure of which is fine, can be produced.

7 Claims, 5 Drawing Sheets

PROCESS FOR CONTINUOUSLY CASTING SHEET METAL AND APPARATUS FOR CONTINUOUSLY PRODUCING SHEET METAL

TECHNICAL FIELD

The present invention relates to a method for producing metallic sheets of fine structure, the surfaces of which are smooth, using a twin drum type continuous casting apparatus. Also, the present invention relates to an apparatus for continuously producing metallic sheets.

BACKGROUND ART

Concerning a method for producing cold-rolled steel sheets, there is provided a method in which thin slabs, the thickness of which is 2 to 10 mm, are made by a twin drum type continuous casting apparatus and used as hot-rolled sheets as they are. Also, there is provided a method in which the above thin slabs are subjected to acid cleaning to remove scale from the surfaces of the slabs, and then the thin slabs are cold-rolled to a predetermined thickness and annealed.

The most important point of the above technique is the physical property of the thin slab made by the twin drum type continuous casting apparatus. According to the above conventional production process, the metallic structure of the thin slabs is coarse before cold rolling (as cast). Therefore, the thus obtained products are applied only to low grade uses. In order to improve the quality of the products, it is necessary to increase a ratio of reduction of cold rolling.

In order to obtain a fine metallic structure, the following methods are disclosed. Japanese Unexamined Patent Publication No. 61-99630 describes a method for producing cold rolled steel sheets in which: a carbon content in molten steel is adjusted to an amount of not lower than 0.015%; a thin steel strip used for cold rolling is directly cast from the above molten steel; after coagulation, the steel strip is cooled to a temperature not higher than 800° C.; the steel strip is reheated to a temperature not lower than 900° C.; the steel strip is cooled again to a temperature not higher than 800° C.; the cooled steel strip is coiled; and the steel strip is subjected to acid cleaning, cold rolling and annealing. Japanese Unexamined Patent Publication No. 60-30545 describes a method for producing cold-rolled steel sheets in which: a continuous casting apparatus is used which has two water-cooled rollers arranged horizontally in parallel with each other while a clearance corresponding to the thickness of a metallic sheet is formed between them, rotated in the different direction to each other; a metallic sheet cast by the above apparatus is naturally cooled to a temperature not higher than the transformation point $A_1$; the metallic sheet is heated to and kept at a temperature not lower than the transformation point $A_3$ on the line; and the metallic sheet is cooled by gas or a mixture of gas and water.

However, length of the apparatus to which the above methods are applied is long because a long period of time is required for the heat treatment in the above apparatus. For example, in the example described in Japanese Patent Application No. 59-226515, operation is conducted as follows. A slab that has been cast by the apparatus is coagulated to the thickness of 3.2 mm; the coagulated slab is cooled by water to 700 to 950° C.; the slab is reheated by direct heating burners for 100 seconds; the slab is kept at 950° C. for 5 seconds; and the slab is coiled while it is cooled to the minimum temperature of 550° C. In this case, the operating conditions are set as follows. The casting speed, by the twin drum method, is approximately 30 m/min; the water-cooling speed to cool the slab to the temperature of 700° C. is 50° C./sec; the reheating time at 950° C. is 100 seconds; and the water-cooling speed to cool the slab to 550° C. is 50° C./sec. Then, the length of the apparatus of cooling—heating—cooling can be expressed by the following equation.

$$\frac{1100-700}{50\times60}\times30+\frac{100}{60}\times30+\frac{950-550}{50\times60}\times30=58\,\text{m} \qquad \text{(Equation 4)}$$

The meaning of Equation (4) is described as follows.

(1) The first term on the left side of Equation 4 expresses the length of the apparatus required for cooling, that is, the length of the apparatus required for cooling is calculated when the period of time (min) required for cooling the slab from 1100° C. to 700° C. is multiplied by the casting speed (30 m/min).

(2) The second term on the left side of Equation 4 expresses the length of the apparatus required for reheating, that is, the length of the apparatus required for reheating is calculated when the period of time (min) required for reheating the slab from 700° C. to 950° C. is multiplied by the casting speed (30 m/min).

(3) The third term on the left side of Equation 4 expresses the length of the apparatus required for cooling, that is, the length of the apparatus required for cooling is calculated when the period of time (min) required for cooling the slab from 950° C. to 550° C. is multiplied by the casting speed (30 m/min).

In the example described in Japanese Patent Application No. 60-30545, when the thickness of the slab is 3 t, the casting speed is 28 m/min, and the heating time to heat the slab from a range of 650 to 700° C., to a range of 900 to 950° C. is 1 to 2 min. The cooling speed is 5° C./sec when the slab is coiled at the coiling temperature of 700° C. Then, the length of the apparatus of cooling—heating—cooling can be expressed by the following equation.

$$\frac{1100-700}{50\times60}\times28+2\times28+\frac{950-700}{5\times60}\times28=83\,\text{m} \qquad \text{(Equation 5)}$$

The meaning of Equation (5) is described as follows.

(1) The first term on the left side of Equation 5 expresses the length of the apparatus required for cooling, that is, the length of the apparatus required for cooling is calculated when the period of time (min) required for cooling the slab from 1100° C. to 700° C. is multiplied by the casting speed (28 m/min).

(2) The second term on the left side of Equation 5 expresses the length of the apparatus required for reheating, that is, the length of the apparatus required for reheating is calculated when the period of time (2 minutes) required for reheating the slab is multiplied by the casting speed (28 m/min).

(3) The third term on the left side of Equation 5 expresses the length of the apparatus required for cooling, that is, the length of the apparatus required for cooling is calculated when the period of time (min) required for cooling the slab from 950° C. to 700° C. is multiplied by the casting speed (28 m/min).

On the surfaces of the slabs produced by the above apparatus, there are irregularities, that is, the surface conditions of the slabs produced by the above apparatus are different from those of the hot-rolled sheets produced by a conventional hot rolling mill. Therefore, the use of the slabs produced by the above apparatus is restricted. It is an object of the present invention to shorten the length of the apparatus for producing thin slabs, so that energy can be saved in the process of production. It is another object of the present invention to improve the surface roughness of the slab and make the crystal grain size of the slab to be fine.

SUMMARY OF THE INVENTION

The present inventors have discovered the following facts. When a thin steel strip, which has been directly cast from molten steel, is lightly reduced before it is subjected to heat treatment, the temperature, at which the metallic structure is transformed from γ-structure to α-structure in the process of cooling conducted after casting, is raised higher than that of the case in which no reduction is given to the slab.

Characteristics of the method of producing steel sheets of the present invention will be described below.

1. The present invention is to provide a method for continuously casting steel sheets comprising the steps of: adjusting a carbon content of molten steel to be not lower than 0.001%; directly casting a thin steel strip used for cold rolling from this molten steel; giving a light reduction of not lower than 10% to the thin steel strip; cooling the reduced thin steel strip; reheating the cooled thin steel strip; cooling the reheated thin steel strip; and coiling the cooled thin steel strip.

2. The present invention is to provide a method for continuously casting steel sheets comprising the steps of: adjusting a carbon content of molten steel to be not lower than 0.001%; directly casting a thin steel strip used for cold rolling from this molten steel; giving a light reduction of not lower than 10% to the thin steel strip; for controlling the γ-grain size of the thin steel strip before recrystallization to be not more than 100 μm, and controlling the surface roughness ($R_{max}$) of the thin steel strip to be not more than 15 μm; cooling the reduced thin steel strip; reheating the cooled thin steel strip; cooling the reheated thin steel strip; and coiling the cooled thin steel strip.

3. The present invention is to provide a method for continuously casting steel sheets comprising the steps of: adjusting a carbon content of molten steel to be not lower than 0.001%; directly casting a thin steel strip from this molten steel; giving a light reduction of not lower than 10% to the thin steel strip; cooling the coagulated steel strip to a temperature not higher than T1° C.; reheating the cooled thin steel strip to a temperature not lower than T2° C.; cooling the reheated thin steel strip to a temperature not higher than T3° C.; and coiling the cooled thin steel strip, wherein T1 is a function of the carbon content, ratio of reduction (RR) and cooling speed (CR), and T2 and T3 are functions of the carbon content.

$$T1=A(-295.45[C]-32.72)+B(363.63[C]-151.51)+(-1477.27[C]+1171.36) \quad \text{(Equation 1)}$$

where A: common logarithm of the cooling speed (°C./s)
[C]: carbon concentration (%)
B: function of the ratio of in-line reduction (=750/(90×ILRR+1)
ILRR: ratio of in-line reduction $$T2=-2000\times[C]+980\ (°C.) \quad \text{(Equation 2)}$$

$$T3=-9000\times[C]+920\ ([C]<0.02\%)\ (°C.) \quad \text{(Equation 3-1)}$$

$$T4=740°\ C.\ ([C]\geqq 0.02\%)\ (°C.) \quad \text{(Equation 3-2)}$$

In this case, the accuracy of temperature is ±10° C.

4. The present invention is to provide a method for continuously casting steel sheets according to item 1, 2 or 3, wherein the final cold-rolled thin steel strip is produced by common steel, the carbon content of which is 0.001 to 0.25%, and the tensile strength of which is 30 to 40 kg/mm$^2$.

5. The present invention is to provide an apparatus for continuously producing steel sheets comprising: a rolling device for giving a light reduction; a cooling device; a heating device; a cooling device; and a coiler, wherein these devices are continuously arranged in order on the downstream side of a twin drum type continuous casting apparatus used for casting steel sheets continuously.

THE MOST PREFERRED EMBODIMENT

The present invention will be specifically explained as follows.

(1) Ratio of Reduction

Figure 1:
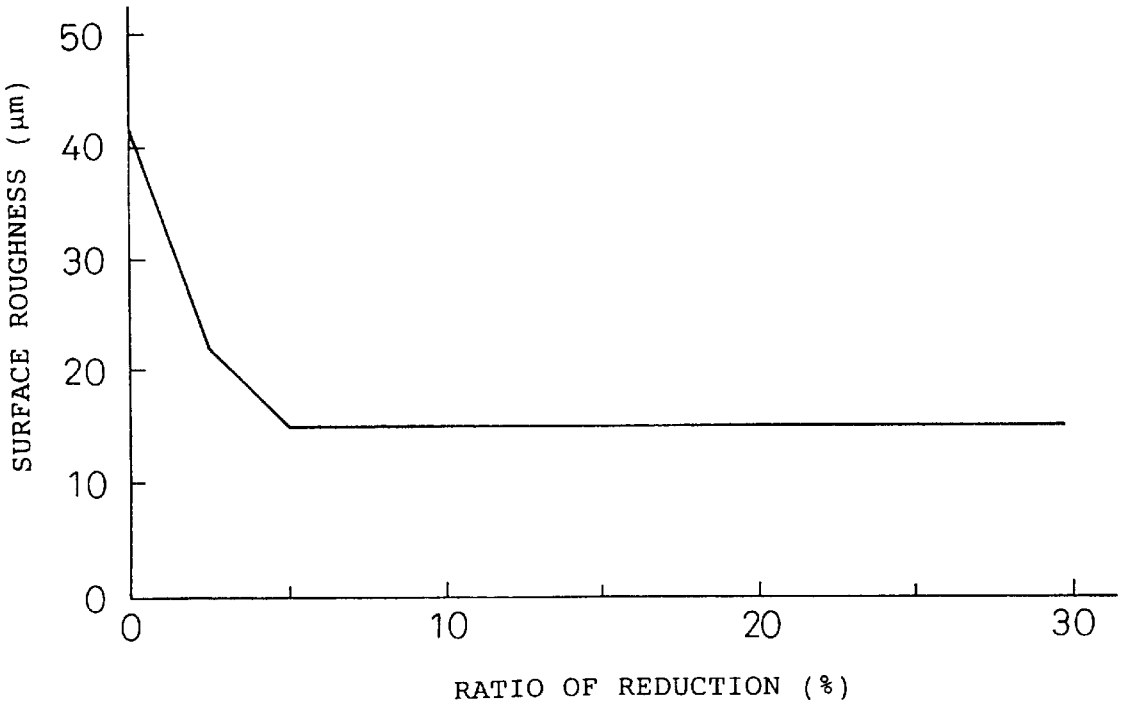
FIG. 1 is a graph showing a relation between the ratio of in-line reduction and the surface roughness $R_{max}$.
Figure 2:
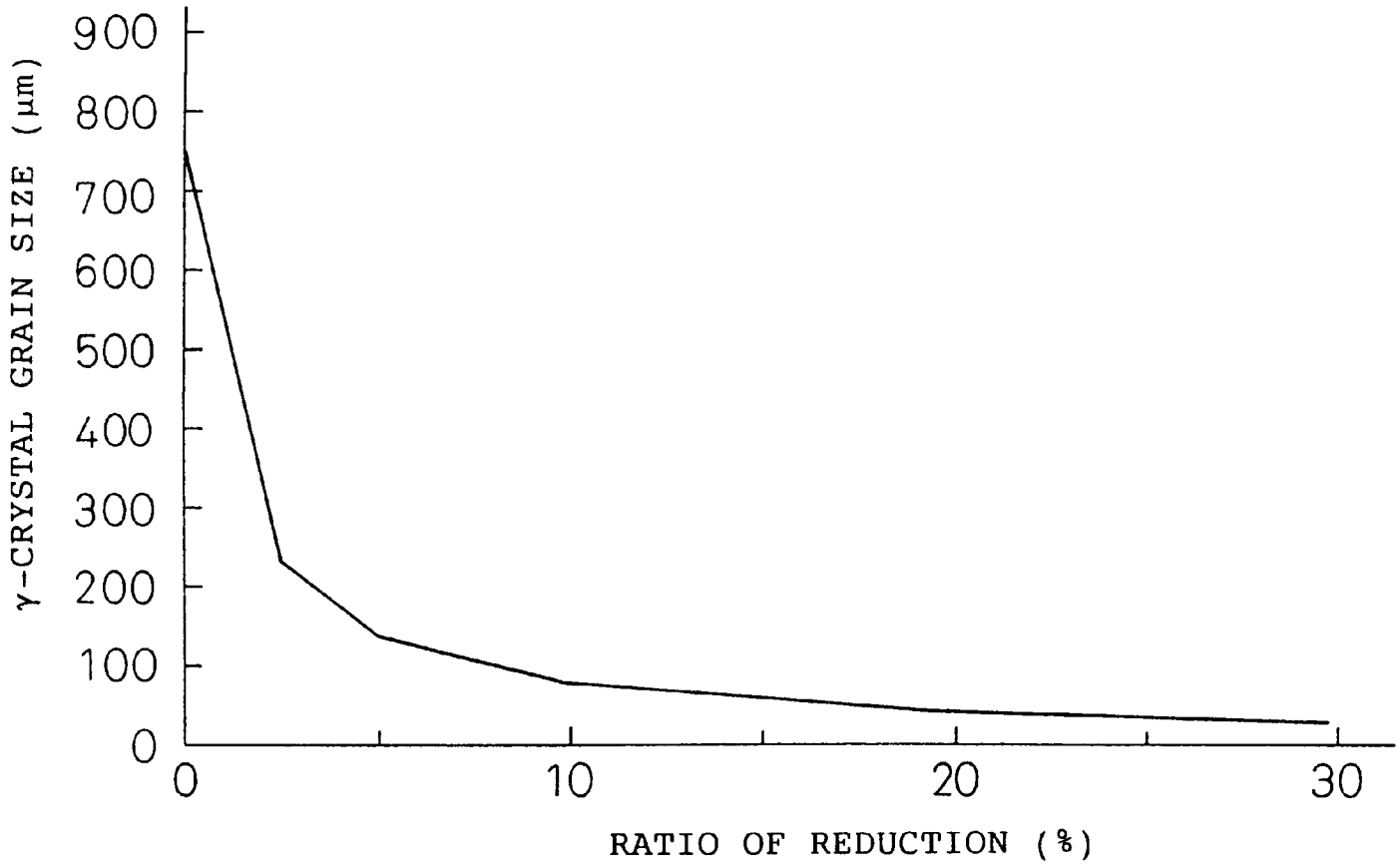
FIG. 2 is a graph showing a relation between the ratio of in-line reduction and the γ-grain size immediately after a reduction has been given.

In order to improve the surface roughness, it is necessary to conduct rolling at the ratio of reduction of not lower than 5% as shown in FIG. 1. When the slab is rolled, it is possible to raise the temperature T1. The reason why the temperature T1 is raised is that the γ-grain size before recrystallization is decreased by rolling, so that the crystallization interface can be increased and the transformation into the α-region can be easily performed. According to the result of the experiment made by the inventors, it was found that in order to make the γ-grain size to be not more than 100 μm before recrystallization, it is necessary to conduct rolling at the ratio of reduction of not lower than 10%, and it is preferable to conduct rolling at the ratio of reduction of not lower than 10% and not higher than 30% as shown in FIG. 2.

(2) Cooling Temperature (T1)

Figure 3:
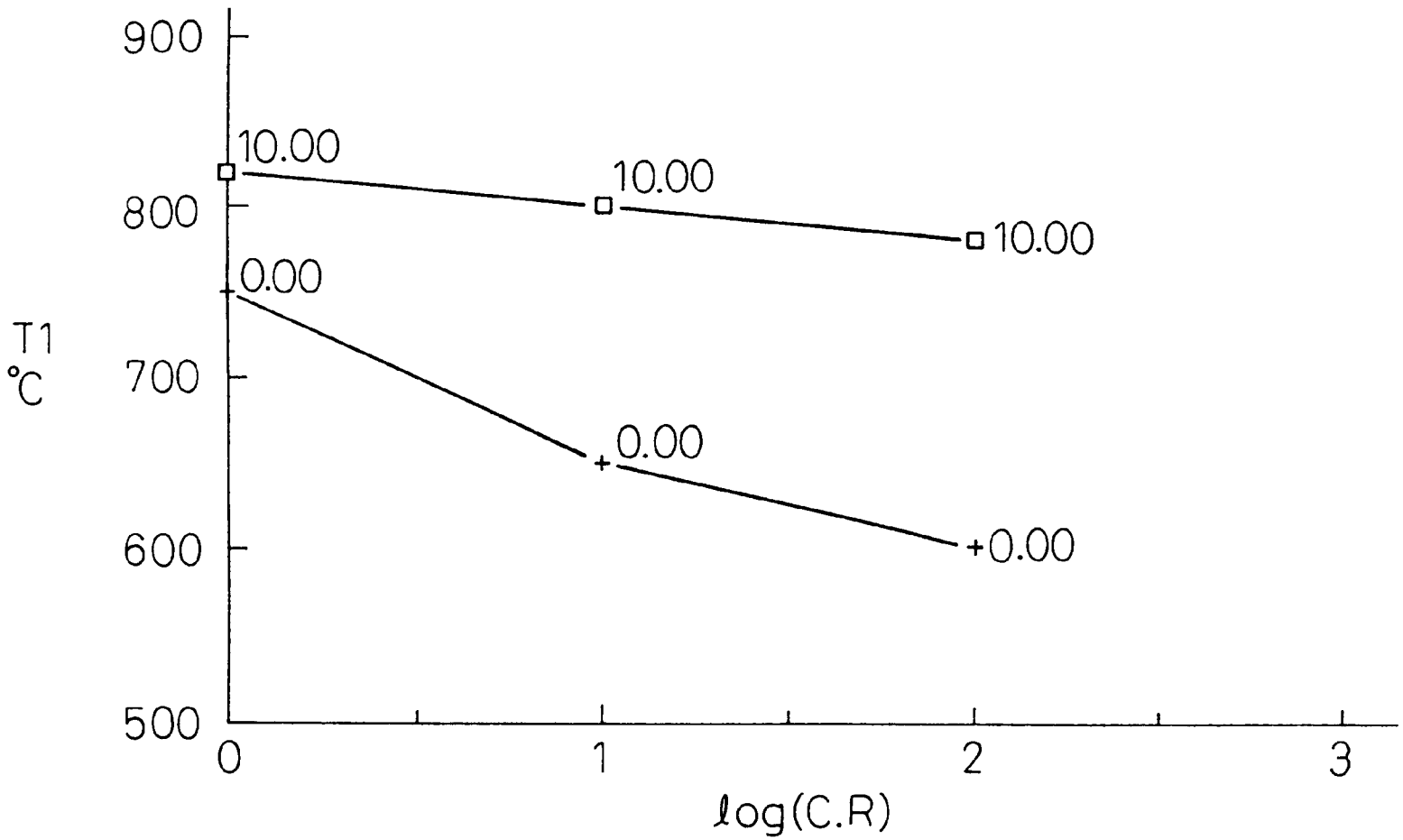
FIG. 3 is a graph showing a relation between the cooling speed and the temperature T1 in the case of carbon concentration of 0.05%.
Figure 4:
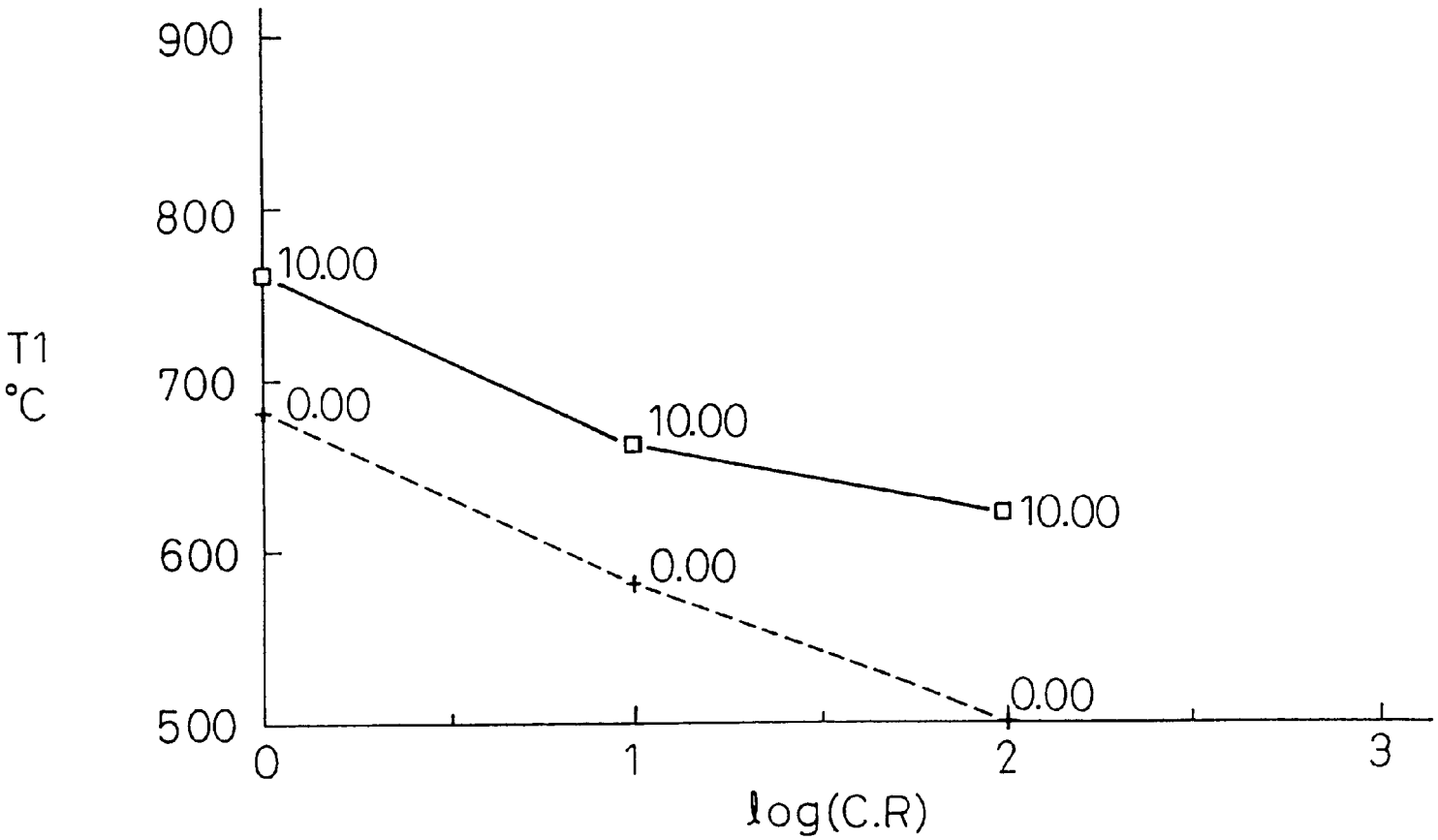
FIG. 4 is a graph showing a relation between the cooling speed and the temperature T1 in the case of carbon concentration of 0.16%.

Temperature T1 at which the γ-grain is transformed into the α-grain is affected by the γ-grain size before rolling, the cooling speed and the carbon concentration. The γ-grain size before rolling is a function of the ratio of reduction of in-line. The γ-grain size is 500 to 1000 μm after the slab has been cast. When the slab is rolled at the ratio of reduction of 10%, the γ-grain size is decreased to a value not more than 100 μm. In FIG. 3, there is shown a relation between the cooling speed and the temperature T1 when the carbon concentration is 0.05%. When the slab is rolled at the ratio of reduction of 10%, temperature T1 is raised. This temperature is changed by the carbon concentration. That is, when the carbon concentration is increased, this temperature is decreased as shown by Equation (1). The relation between the cooling speed and the temperature T1 is shown in FIG. 4 when the carbon concentration is 0.16%.

$$T1=A(-295.45[C]-32.72)+B(363.63[C]-151.51)+(-1477.27[C]+1171.36) \quad \text{(Equation 1)}$$

where A: common logarithm of the cooling speed (°C./s)

[C]: carbon concentration (%)

B: function of the ratio of in-line reduction (=750/(90×ILRR+1)

ILRR: ratio of in-line reduction (3) Reheating Temperature (T2)

The reheating temperature is determined by the carbon concentration. This relation is shown by Equation 2. That is, the reheating temperature is a temperature at which the γ-crystal is generated again on the interface of the α-grain. When the temperature is lower than T2, the γ-crystals are not sufficiently generated.

$$T2=-2000\times[C]+980 \ (°C.) \quad \text{(Equation 2)}$$

(4) Coiling Temperature (T3)

Coiling temperature (T3) is determined to be not higher than the temperature of recrystallization. This temperature is affected by the carbon concentration and expressed by Equation 3.

$$T3=-9000\times[C]+920 \ ([C]<0.02\%) \ (°C.) \quad \text{(Equation 3-1)}$$

$$T3=740° \ C. \ ([C]\geqq 0.02\%) \ (°C.) \quad \text{(Equation 3-2)}$$

In this connection, the cold-rolled steel strip, which is the final product according to the present invention, is produced by common steel, the carbon content of which is 0.001 to 0.25% and the tensile strength of which is 30 to 40 kg/mm$^2$. This cold-rolled steel strip of the final product can be produced in such a manner that after the slab according to the present invention has been made, it is subjected to the arbitrary processes of acid cleaning, cold rolling, annealing and so forth.

Figure 5:
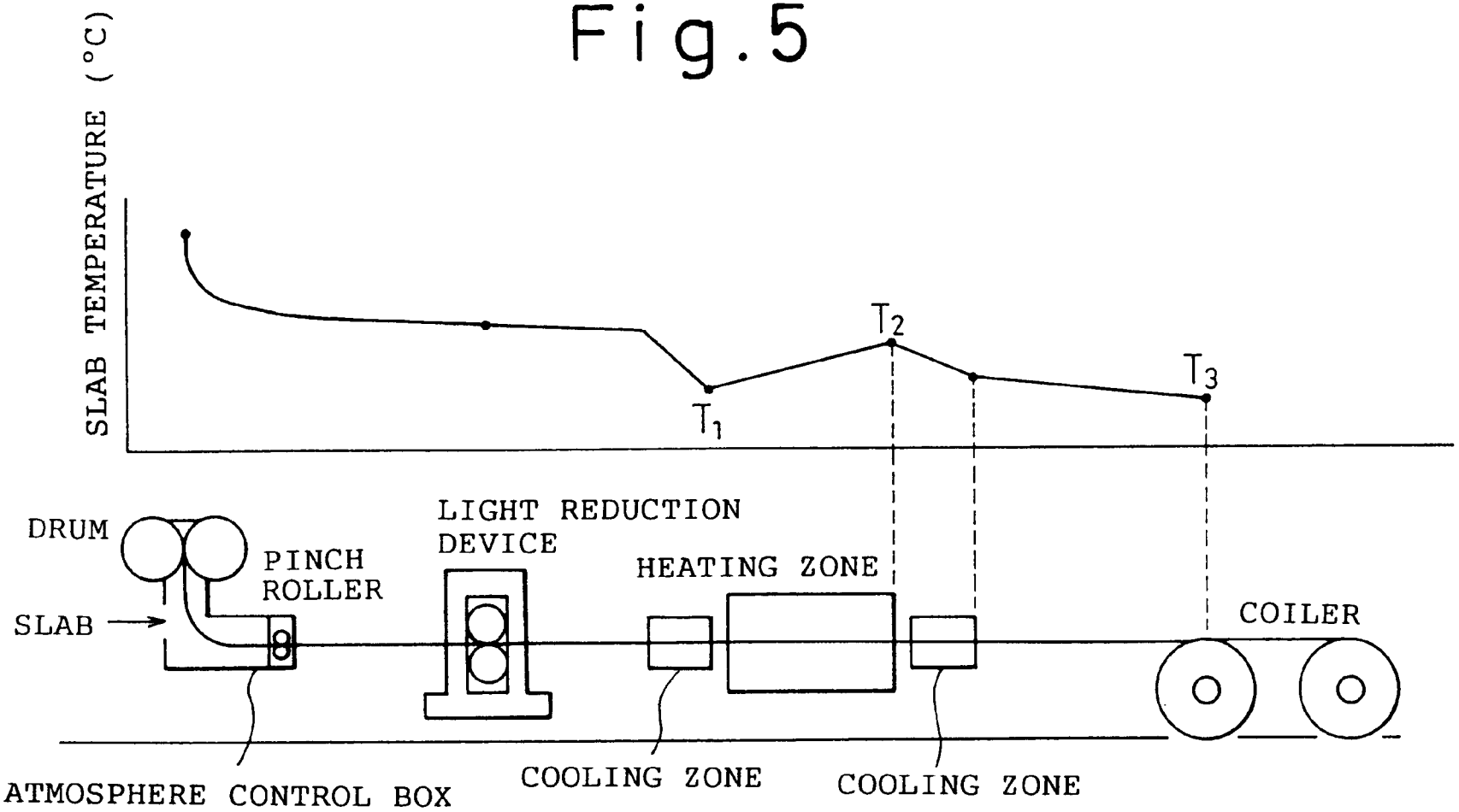
FIG. 5 is an overall arrangement view of the continuous steel sheet producing apparatus of the present invention.

In order to realize the method of the present invention, it is preferable to use a continuous sheet producing apparatus as illustrated in FIG. 5, including: a rolling device to give a light reduction arranged on the downstream side of a twin drum type continuous casting apparatus, a cooling device, a heating device, a cooling device and a coiling device.

In this connection, the cooling system of each cooling device described above may be a water cooling system or a mist cooling system. The heating system of each heating device described above may be a gas heating system or an induction heating system by which slabs can be quickly heated.

EXAMPLES

Example 1

The following is an example in which a slab of 3 mm thickness, the carbon content of which was 0.05%, was made by means of casting. The casting conditions are described as follows. The casting speed was 30 m/min, the ratio of reduction was 10%, the water cooling speed was 50° C./sec, the heating speed was 2.5° C./sec, and the cooling speed after heating was 5° C./sec. The temperature T1 was 767° C., the reheating temperature T2 was 880° C., and the coiling temperature was 740° C.

Then, the length of the apparatus of heating—cooling—heating can be expressed by the following equation.

$$\frac{1100-767}{50\times 60}\times 30+\frac{880-767}{2.5\times 60}\times 30+\frac{880-740}{5\times 60}\times 30=40 \text{ m} \quad \text{(Equation 6)}$$

The meaning of Equation 6 is described as follows.

(1) The first term on the left side of Equation 6 expresses the length of the apparatus required for cooling after rolling has been conducted at the ratio of reduction of 10%, that is, the length of the apparatus required for cooling is calculated when a period of time (minute) necessary for cooling from 1100° C. to 767° C. is multiplied by a casting speed (30 m/min).

(2) The second term on the left side of Equation 6 expresses the length of the apparatus required for reheating, that is, the length of the apparatus required for reheating is calculated when a period of time necessary for reheating from 767° C. to 880° C. at 2.5° C./sec is multiplied by a casting speed (30 m/min).

(3) The third term on the left side of Equation 6 expresses the length of the apparatus required for cooling, that is, the length of the apparatus required for cooling is calculated when a period of time (minutes) necessary for cooling from 880° C. to 740° C., at which the cooled strip is coiled, is multiplied by a casting speed (30 m/min).

In the case where no reduction is given to the slab, the above result can be directly compared with Equation 5 described in Japanese Patent Application No. 60-30545, because the heating time from 650° C. to 950° C. in Equation 5 has the same meaning as the heating speed of 2.5° C./sec. Therefore, when a reduction is given to the slab, the length 83 m of the heat treatment device can be shortened to 40 m. The surface roughness $R_{max}$ of the thus obtained slab was 10 μm, which was equivalent to the surface roughness of a hot-rolled steel sheet. The crystal grain size of the thus obtained slab was 20 μm, which was equivalent to the crystal grain size of a hot-rolled steel sheet used at present. Concerning the mechanical property, surface roughness and brittleness, excellent results were provided by the thus obtained product.

Example 2

Table 1 shows the results of experiments in which steel sheets were produced while the length of the heating furnace zone was variously changed.

In Table 1, Example Nos. 1 to 6 are the examples of the present invention. In Nos. 1 to 3, the carbon concentration was changed in a range from 0.05 to 0.16. Comparative Examples are shown in No. 1-ref to No. 3-ref. In all cases, the length of the heat treatment apparatus was shortened by about 10 m.

In Example Nos. 4 to 6, the periods of time T1, T2 and T3 were changed by 10%.

According to the above examples, it is clear that the heating furnace zone could be shortened by conducting rolling on the slab. The crystal grain size of the thus obtained slab was approximately 20 μm, and quality of the slab was high with respect to surface roughness and brittleness.

TABLE 1

| | NO | [C] (%) | Ratio of reduction (%) | Cooling speed (° C./s) | T1 (° C.) | T2 (° C.) | T3 (° C.) | Vc (m/min) | length (m) |
|---|---|---|---|---|---|---|---|---|---|
| Example of the present invention | 1 | 0.05 | 10 | 10 | 800 | 880 | 740 | 30 | 26 |
| | 2 | 0.02 | 10 | 10 | 833 | 940 | 740 | 30 | 29 |
| | 3 | 0.16 | 10 | 10 | 680 | 660 | 740 | 30 | 16 |
| | 4 | 0.05 | 10 | 5 | 814 | 880 | 740 | 30 | 49 |
| | 5 | 0.05 | 10 | 10 | 720 | 968 | 814 | 30 | 39 |
| | 6 | 0.05 | 10 | 10 | 720 | 792 | 592 | 30 | 33 |
| Comparative example (no reduction) | 1-ref | 0.05 | 0 | 10 | 667 | 880 | 740 | 30 | 39 |
| | 2-ref | 0.02 | 0 | 10 | 688 | 940 | 740 | 30 | 43 |
| | 3-ref | 0.16 | 0 | 10 | 587 | 660 | 740 | 30 | 25 |
| | 4-ref | 0.05 | 0 | 5 | 681 | 880 | 740 | 30 | 76 |

INDUSTRIAL AVAILABILITY

As described above, according to the present invention, after a reduction has been given to a cast metallic slab, it is cooled from the γ-transformation point to a temperature not higher than the α-transformation point. After that, the slab is heated from the α-transformation point to a temperature not lower than γ-transformation point. Then the slab is cooled. Due to the foregoing heat treatment process, as compared with a simple heat treatment process in which the slab is cooled and heated to make the crystal grains fine, it is possible to obtain a thin slab, the metallic structure of which is fine, by a production apparatus, the length of which is shortened. Accordingly, while energy is saved and the production apparatus is made compact, it is possible to obtain a slab, the quality of which is equivalent to that of a good hot-rolled steel sheet.

We claim:

1. A method for continuously casting steel sheets comprising the steps of: adjusting a carbon content of molten steel to be not lower than 0.001% and not greater than 0.25%; directly casting a thin steel strip used for cold rolling from this molten steel; giving a light reduction of not lower than 10% and not greater than 30% to the thin steel strip; cooling the reduced thin steel strip; reheating the cooled thin steel strip; cooling the reheated thin steel strip; and coiling the cooled thin steel strip.

2. A method for continuously casting steel sheets comprising the steps of: adjusting a carbon content of molten steel to be not lower than 0.001% and not greater than 0.25%; directly casting a thin steel strip used for cold rolling from this molten steel; giving a light reduction of not lower than 10% and not greater than 30% to the thin steel strip for controlling the γ-grain size of the thin steel strip before recrystallization to be not more than 100 μm and controlling the surface roughness (Rmax) of the thin steel strip to be not more than 15 μm; cooling the reduced thin steel strip; reheating the cooled thin steel strip; cooling the reheated thin steel strip; and coiling the cooled thin steel strip.

3. A method for continuously casting steel sheets comprising the steps of: adjusting a carbon content of molten steel to be not lower than 0.001% and not greater than 0.25%; directly casting a thin steel strip used for cold rolling from this molten steel; giving a light reduction of not lower than 10% and not greater than 30% to the thin steel strip; cooling a coagulated steel strip to a temperature at least not higher than T1 ° C.; reheating the cooled steel strip to a temperature not lower than T2 ° C.; cooling the reheated steel strip to a temperature not higher than T3 ° C.; and coiling the cooled steel strip, wherein T1 is a function of the carbon content, cooling speed and ratio of in-line reduction, and T2 and T3 are functions of the carbon content; wherein:

$$T1=A(-295.45(C)-32.72)+B(363.63(C)-151.51)+(-1477.27(C)+1171.36) \quad \text{(Equation 1)}$$

where A: common logarithm of the cooling speed (° C./s)

(C): carbon concentration (%)

B: function of the ratio of in-line reduction (=750/(90 X ILRR+1)

ILRR: ratio of in-line reduction $$T2=-2000 \times (C)+980\ (^\circ C.) \quad \text{(Equation 2)}$$

$$T3=-9000 \times (C)+920\ ((C)<0.02\%)\ (^\circ C.) \quad \text{(Equation 3)}$$

wherein, the accuracy of T1, T2 and T3 is ±10° C.

4. A method for continuously casting steel sheets according to claim 1, wherein the final cold-rolled thin steel strip is made of steel, the carbon content of which is 0.001 to 0.25%, and the tensile strength of which is 30 to 40 kg/mm$^2$.

5. An apparatus for continuously producing steel sheets comprising: a rolling device for giving a light reduction; a cooling device; a heating device; a cooling device; and a coiler, wherein these devices are continuously arranged in order on the downstream side of a twin drum continuous casting apparatus used for continuously casting steel sheets.

6. A method for continuously casting steel sheets according to claim 2, wherein the final cold-rolled thin steel strip is made of steel, the carbon content of which is 0.001 to 0.25%, and the tensile strength of which is 30 to 40 kg/mm$^2$.

7. A method for continuously casting steel sheets according to claim 3, wherein the final cold-rolled thin steel strip is made of steel, the carbon content of which is 0.001 to 0.25%, and the tensile strength of which is 30 to 40 kg/mm$^2$.

* * * * *